US009291360B2

(12) United States Patent
Kawaguchi

(10) Patent No.: US 9,291,360 B2
(45) Date of Patent: Mar. 22, 2016

(54) OUTDOOR UNIT FOR AIR-CONDITIONING APPARATUS AND AIR-CONDITIONING APPARATUS INCLUDING THE SAME

(71) Applicant: Mitsubishi Electric Corporation, Tokyo (JP)

(72) Inventor: Yohei Kawaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 221 days.

(21) Appl. No.: 14/040,904

(22) Filed: Sep. 30, 2013

(65) Prior Publication Data

US 2014/0132127 A1 May 15, 2014

(30) Foreign Application Priority Data

Nov. 12, 2012 (JP) ..... 2012-248494

(51) Int. Cl.
*F24F 13/20* (2006.01)
*F24F 1/56* (2011.01)

(52) U.S. Cl.
CPC .. *F24F 13/20* (2013.01); *F24F 1/56* (2013.01)

(58) Field of Classification Search
CPC ..... Y10T 16/462; Y10T 16/509
USPC ..... 312/100, 244, 332.1; 16/415, 443; D8/313, 314
See application file for complete search history.

(56) References Cited

U.S. PATENT DOCUMENTS 1,304,700 A * 5/1919 Otte ..... 16/412
2,793,386 A * 5/1957 Muhlhauser ..... A47B 95/02 16/416
4,153,314 A * 5/1979 Prater ..... A45C 13/26 16/110.1
D349,838 S * 8/1994 Barton ..... D8/301
5,355,554 A * 10/1994 Magoon ..... 16/412
5,927,836 A * 7/1999 Herr et al. ..... 312/244
2010/0281651 A1* 11/2010 Ramsauer ..... 16/110.1
2012/0194041 A1* 8/2012 Hika ..... F24F 1/46 312/100
2012/0274188 A1* 11/2012 Shiborino ..... F24F 1/20 312/100

FOREIGN PATENT DOCUMENTS

CN 203595197 U 5/2014
JP 07-055202 A 3/1995
JP 08-094127 A 4/1996
JP 2006-284043 A 10/2006
JP 2010-175134 A 8/2010
KR 10 2006 0132170 A 12/2006
WO WO2011055610 * 5/2011

OTHER PUBLICATIONS

Office Action mailed on Nov. 4, 2014 in corresponding JP Application No. 2012-248494 (with English translation).
Office Action dated Jun. 30, 2015 issued in corresponding AU patent application No. 2013238794.
Office Action issued Oct. 29, 2015 in the corresponding CN application No. 201310562375.2 (with English translation).

* cited by examiner

*Primary Examiner* — Matthew Ing
(74) *Attorney, Agent, or Firm* — Posz Law Group, PLC

(57) ABSTRACT

[Object] To provide an outdoor unit for an air-conditioning apparatus, which solves a manufacturing problem in that a grip is not easily taken out from a mold, and an air-conditioning apparatus including the outdoor unit.

[Solution] There is included a grip formed by fitting two components.

19 Claims, 7 Drawing Sheets

OUTDOOR UNIT FOR AIR-CONDITIONING APPARATUS AND AIR-CONDITIONING APPARATUS INCLUDING THE SAME

TECHNICAL FIELD

The present invention relates to an outdoor unit for an air-conditioning apparatus and an air-conditioning apparatus including the outdoor unit, and more particularly, to a grip used to transport the outdoor unit.

BACKGROUND ART

There has been proposed an outdoor unit for an air-conditioning apparatus with a grip that allows an operator or the like to easily carry the outdoor unit when installing the outdoor unit (see, for example, Patent Literature 1).

In the technique described in Patent Literature 1, a grip is fitted in an opening provided in a planar portion or a corner portion of an outer panel that is formed of, for example, sheet metal. This allows the operator to hold the grip with fingers being inserted therein.

For this reason, the technique described in Patent Literature 1 can provide higher operability in carrying the outdoor unit than an outdoor unit having no grip.

CITATION LIST

Patent Literature

[Patent Literature 1] Japanese Unexamined Patent Application Publication No. 8-94127 (see, for example, claim 1, paragraph [0016] of the specification, and FIG. 1)

SUMMARY OF INVENTION

Technical Problem

In the technique described in Patent Literature 1, the grip is manufactured as an integral molding of synthetic resin, such as polypropylene (PP), by injection molding using a mold. Since the integrally molded grip is obtained in this way, it is necessary to consider taking out the grip from the mold after injection molding. Thus, there is a restriction on the shape of the grip. That is, after the synthetic resin is injected into the mold, the mold is opened, and the molded grip is taken out from the mold. However, the mold and the grip are sometimes caught by each other depending on the molded shape of the grip, and the grip is not smoothly taken out from the mold.

Since there is such a restriction on the shape of the grip in the technique of Patent Literature 1, it is difficult to set the shape of the grip such that the space in which fingers are to be inserted is wide. Thus, the operator does not easily insert one's fingers in the grip, and this reduces operability in carrying the outdoor unit.

The present invention has been made to solve at least one of the above-described problems, and an object of the invention is to provide an outdoor unit for an air-conditioning apparatus, which solves a manufacturing problem in that a grip is not easily taken out from a mold, and an air-conditioning apparatus including the outdoor unit.

Solution to Problem

An outdoor unit for an air-conditioning apparatus according to the present invention includes a grip formed by fitting two components.

Advantageous Effects of Invention

The outdoor unit for the air-conditioning apparatus according to the present invention has the above-described configuration. This can solve the manufacturing problem in that the grip is not easily taken out from the mold.

DESCRIPTION OF EMBODIMENTS

Embodiment 1 of the present invention will be described below with reference to the drawings.

Embodiment 1

Figure 1:
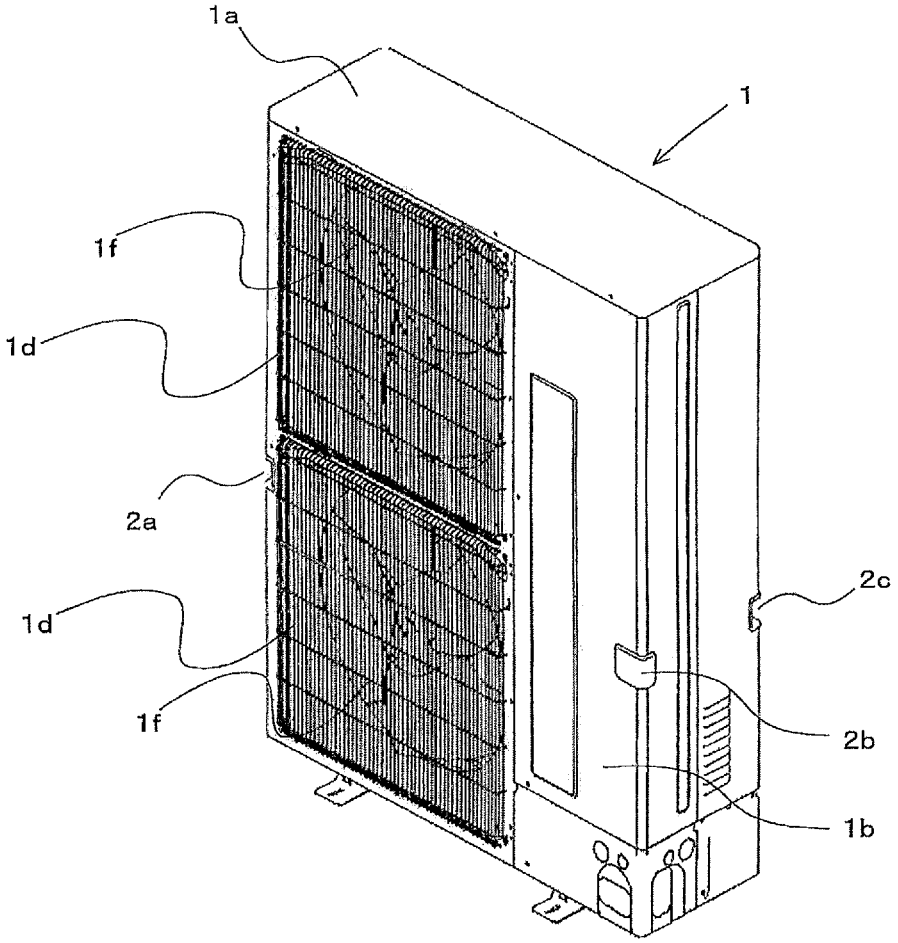
FIG. 1 is a front perspective view of an outdoor unit for an air-conditioning apparatus according to Embodiment 1 of the present invention.
Figure 2:
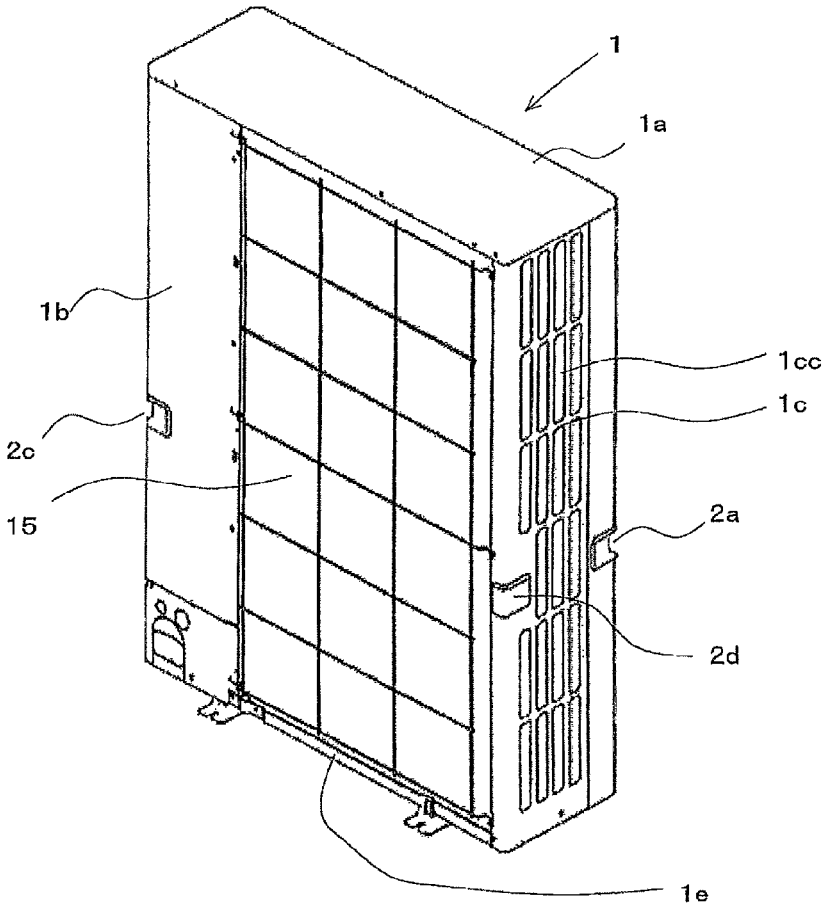
FIG. 2 is a rear perspective view of the outdoor unit illustrated in FIG. 1.

FIG. 1 is a front perspective view of an outdoor unit 1 for an air-conditioning apparatus according to Embodiment 1. FIG. 2 is a rear perspective view of the outdoor unit 1 illustrated in FIG. 1. The outdoor unit 1 will be described with reference to FIGS. 1 and 2.

In the outdoor unit 1 for the air-conditioning apparatus according to Embodiment 1, grips 2*a* to 2*d* provided in the outdoor unit 1 and used to carry the outdoor unit 1 are improved, and manufacturing restrictions imposed on the shape of the grips can be relaxed.

[Configuration of Outdoor Unit 1]

The air-conditioning apparatus includes an unillustrated indoor unit and the outdoor unit 1, and these units are connected by a refrigerant pipe. The indoor unit includes, for example, an unillustrated indoor heat exchanger that functions as an evaporator during a cooling operation and functions as a condenser during a heating operation. A configuration of the outdoor unit 1 will be described below.

[Outdoor Unit 1]

As illustrated in FIGS. 1 and 2, an outer housing of the outdoor unit 1 includes a top panel 1*a* that forms an upper surface of the outdoor unit 1, an outer panel 1*b* that forms a part of a front surface, one side surface, and a part of a rear surface of the outdoor unit 1, a side panel 1*c* that forms the other side surface of the outdoor unit 1, fan guards 1*d* provided on the outer panel 1*b* to form a part of the front surface of the outdoor unit 1, and a bottom plate 1*e* that forms a bottom surface of the outdoor unit 1.

The outer housing of the outdoor unit 1 are also provided with grips 2*a* to 2*d* that can be used by an operator to carry the outdoor unit 1.

Further, in the outer housing of the above-described outdoor unit 1, a compressor that compresses a refrigerant, an outdoor heat exchanger 15 that functions as a condenser during the cooling operation and functions as an evaporator during the heating operation, propeller fans 1*f* that supply outdoor air to the outdoor heat exchanger 15, etc. are installed. As illustrated in FIG. 2, a portion of the rear surface of the outdoor unit 1 except for the outer panel 1*b* is partially open. Hence, a rear side of the outdoor heat exchanger 15 is exposed.

[Top Panel 1*a*]

The top panel 1*a* forms the upper surface of the outdoor unit 1. The top panel 1*a* is provided with a front end portion, one side end portion, and a rear end portion being in contact with the outer panel 1*b* and with the other side end portion being in contact with the side panel 1*c*.

[Outer Panel 1*b*]

The outer panel 1*b* forms a part of the rear surface, one side surface, a part of the front surface, and a part of the other side surface of the outdoor unit 1. The outer panel 1*b* is provided with a lower end portion being in contact with the bottom plate 1*e* and with an upper end portion being in contact with the top panel 1*a*.

An end portion of the outer panel 1*b* at the other side surface is provided in contact with the side panel 1*c*. Further, two upper and lower substantially circular openings, in which the propeller fans 1*f* are mounted, are provided in the center of a portion of the outer panel 1*b* that forms the front surface, and the fan guards 1*d* are mounted thereat.

An opening is provided at a corner of the outer panel 1*b* corresponding to a connecting position between a portion that forms the rear surface and a portion that forms the one side surface of the outdoor unit 1 such that the grip 2*c* is to be fitted therein. An opening is provided at a corner of the outer panel 1*b* corresponding to a connecting position between the portion that forms the one side surface and the portion that forms the front surface of the outdoor unit 1 such that the grip 2*b* is to be fitted therein. Also, an opening is provided at a corner of the outer panel 1*b* corresponding to a connecting position between the portion that forms the front surface and a portion that forms the other side surface of the outdoor unit 1 such that the grip 2*a* is to be fitted therein.

[Side Panel 1*c*]

The side panel 1*c* forms a part of the other side surface and a part of the rear surface of the outdoor unit 1. That is, the side panel 1*c* is substantially L-shaped in horizontal cross section. The side panel 1*c* is provided with a front end portion being in contact with the outer panel 1*b*, with an upper end portion being in contact with the top panel 1*a*, and with a lower end portion being in contact with the bottom plate 1*e*. The side panel 1*c* has a plurality of apertures 1*cc* so that air is easily taken into the outdoor heat exchanger 15.

An opening is provided at a corner of the side panel 1*c* corresponding to a connecting position between a portion that forms the part of the rear surface and a portion that forms the part of the other side surface of the outdoor unit 1 such that the grip 2*d* is to be fitted therein.

[Fan Guards 1*d*]

The fan guards 1*d* form a part of the front surface of the outdoor unit 1, and for example, prevent the user from being injured by the propeller fans 1*f*. The fan guards 1*d* are mounted in the substantially circular openings provided in the center of the portion of the outer panel 1*b* that forms the front surface. In correspondence with the two substantially circular openings in which the propeller fans 1*f* are mounted, one fan guard 1*d* is provided on each of the upper and lower sides, that is, two fan guards 1*d* are provided in total.

[Bottom Plate 1*e*]

The bottom plate 1*e* forms the bottom surface of the outdoor unit 1. For example, the unillustrated outdoor heat exchanger 15 is provided on the bottom plate 1*e*. A front end portion, one side end portion, and a rear end portion of the bottom plate 1*e* are in contact with the outer panel 1*b* to support the outer panel 1*b*. The other side end portion of the bottom plate 1*e* is in contact with the side panel 1*c* to support the side panel 1*c*.

[Grips 2*a* to 2*d*]

The grips 2*a* to 2*d* have spaces in which operator's fingers are to be inserted, and are used by the operator to carry the outdoor unit 1. The grips 2*a* to 2*d* are moldings obtained by injecting resin, such as polypropylene, into a predetermined mold.

The grips 2*b* and 2*c* are provided on one side of the outer housing of the outdoor unit 1. The grip 2*b* is provided on a front side of the outer housing of the outdoor unit 1, and the grip 2*c* is provided on a rear side of the outer housing of the outdoor unit 1.

The grip 2*a* and the grip 2*d* are provided on the other side of the outer housing of the outdoor unit 1. The grip 2*a* is provided on the front side of the outer housing of the outdoor unit 1, and the grip 2*d* is provided on the rear side of the outer housing of the outdoor unit 1.

A detailed structure of the grips 2*a* to 2*d* will be described with reference to FIGS. 3 to 7.

[Outdoor Heat Exchanger 15]

The outdoor heat exchanger 15 functions as a condenser (radiator) during the cooling operation and functions as an evaporator during the heating operation. The outdoor heat exchanger 15 stands on the bottom plate 1*e* in the outer housing of the outdoor unit 1. As illustrated in FIG. 2, the rear side of the outdoor heat exchanger 15 is exposed so as to promote heat exchange between air and the refrigerant.

[Propeller Fans 1*f*]

The propeller fans 1*f* supply outdoor air to the outdoor heat exchanger 15. The propeller fans 1*f* are connected, via shafts, to an unillustrated motor for rotating the fans 1*f*. For example, this motor is supported in the outer housing of the outdoor unit 1 by an unillustrated motor support suspended on the outdoor heat exchanger 15. One propeller fan 1*f* is provided at each of the substantially circular openings provided in the outer panel 1*b*, that is, two propeller fans 1*f* are provided in total.

[Detailed Description 1 of Grips 2*a* to 2*d*]

Figure 3:
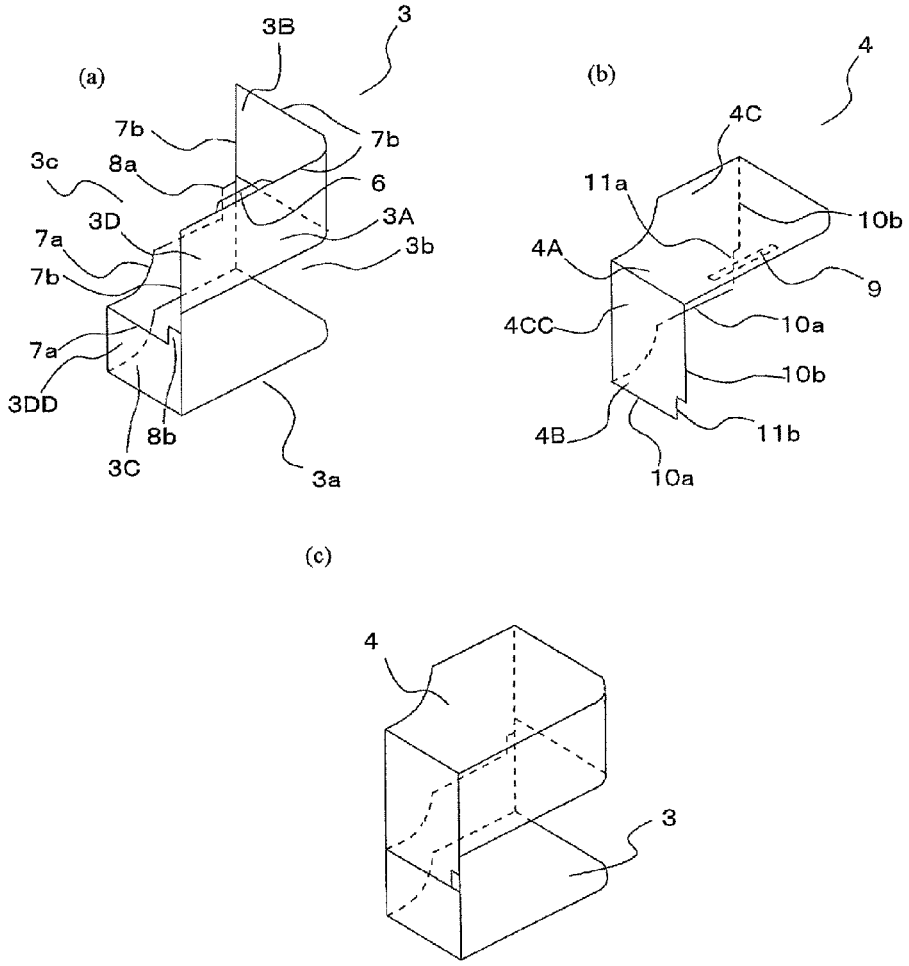
FIG. 3 includes schematic views illustrating a structure of a grip.

FIG. 3 includes schematic views illustrating a structure of the grips 2*a* to 2*d*. FIG. 3(*a*) schematically illustrates a component 3 in each of the grips 2*a* to 2*d*, FIG. 3(*b*) schematically illustrates a component 4 in each of the grips 2*a* to 2*d*, and FIG. 3(*c*) schematically illustrates a state in which the component 3 and the component 4 are combined to form each of the grips 2*a* to 2*d*. Since FIG. 3 includes the schematic views, the thicknesses of the component 3 and the component 4 are not considered.

Figure 4:
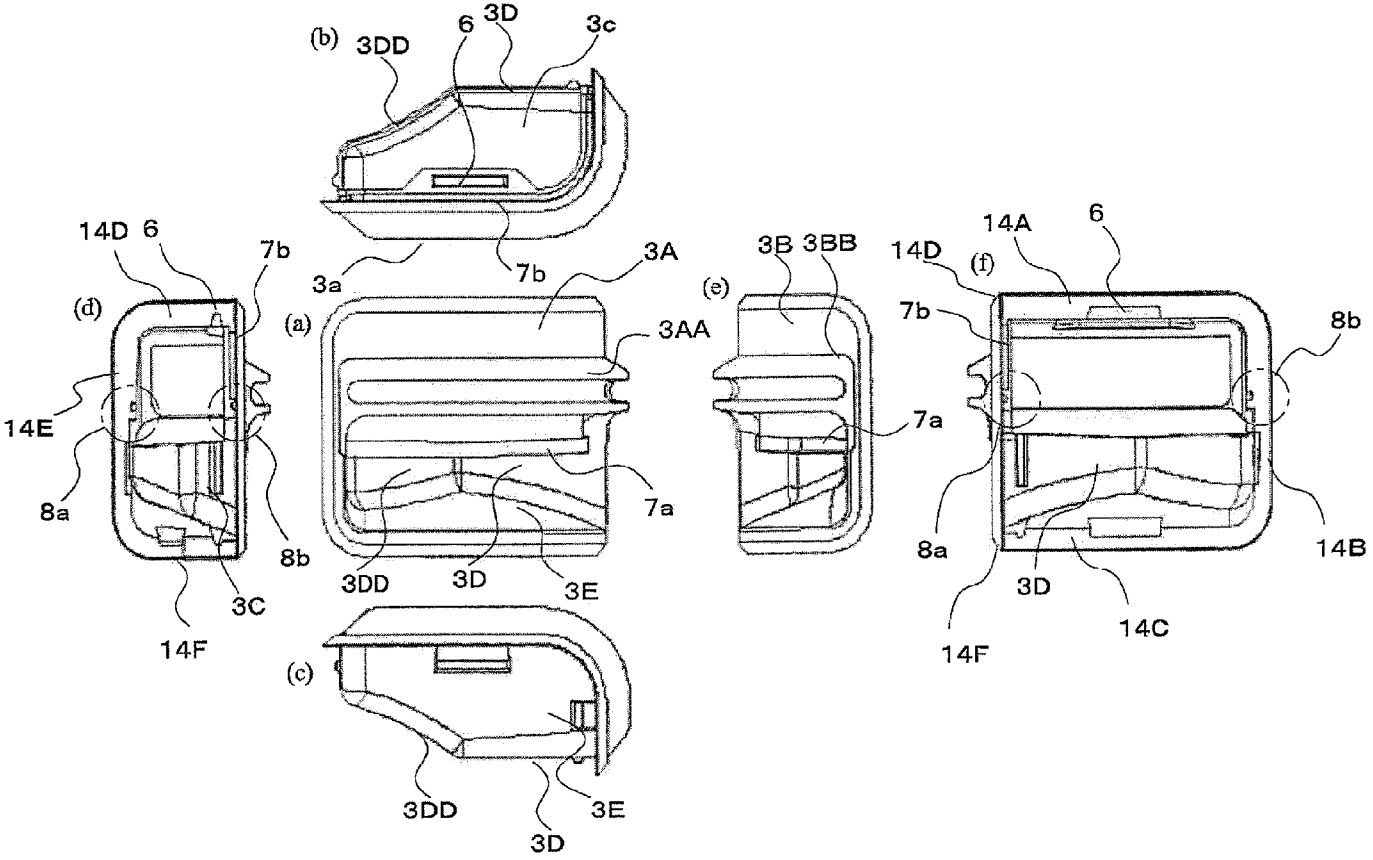
FIG. 4 includes explanatory views of one component that constitutes the grip.
Figure 5:
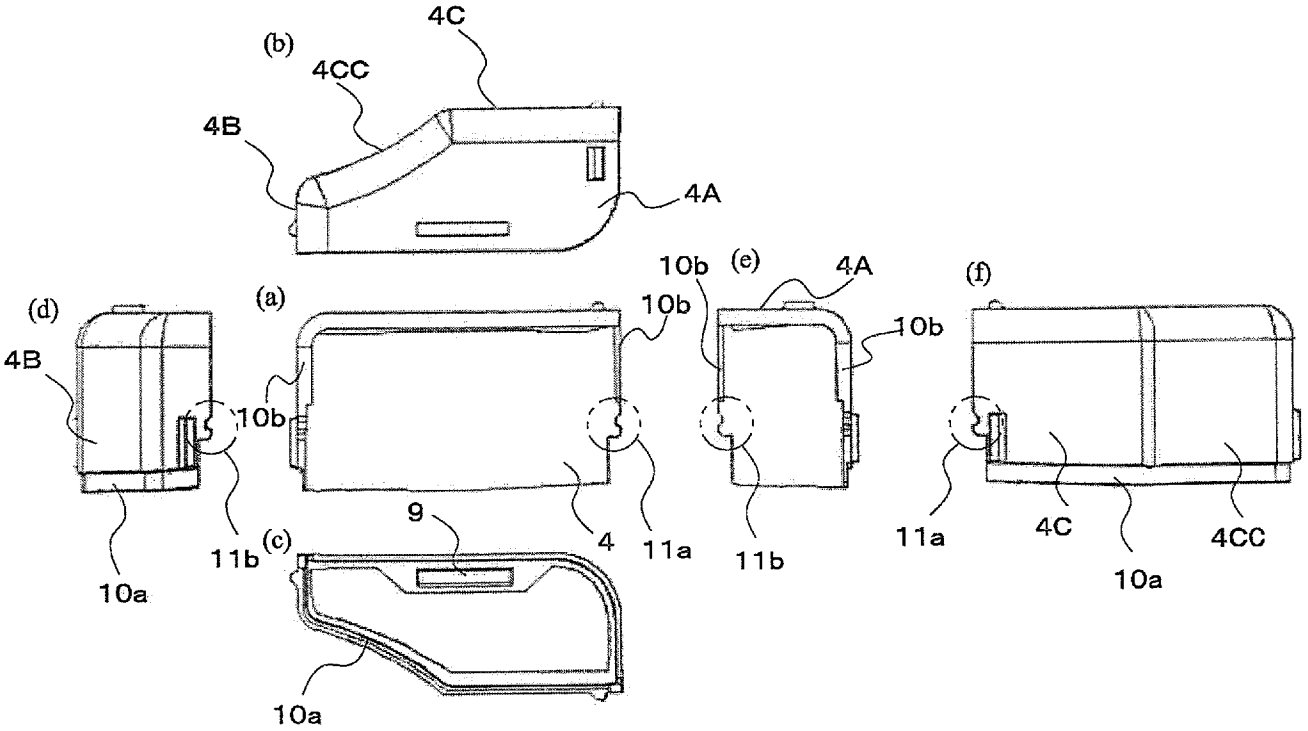
FIG. 5 includes explanatory views of the other component that constitutes the grip.

FIG. 4 includes explanatory views of one of the components that form each of the grips 2*a* to 2*d*, that is, the component 3. FIG. 5 includes explanatory views of the other of the components that form each of the grips 2*a* to 2*d*, that is, the component 4. FIGS. 4(*a*) and 5(*a*) are front views, FIGS. 4(*b*) and 5(*b*) are top views, FIGS. 4(*c*) and (5*c*) are bottom views, FIGS. 4(*d*) and 5(*d*) are left side views (the other side) with respect to the front side, FIGS. 4(*e*) and 5(*e*) are right side (one side) views with respect to the front side, and FIGS. 4(*f*) and 5(*f*) are rear views.

As illustrated in FIG. 3, the grips 2*a* to 2*d* are container-shaped members that are each composed of two components and have spaces in which operator's fingers can be inserted.

That is, each of the grips 2*a* to 2*d* has the component 3 including "a front face portion 3A, a first side face portion 3B, a second side face portion 3C, a rear face portion 3D, and a bottom face portion 3E" that form "a front side, a part of one side, the other side, a part of a rear side, and a bottom side" thereof, respectively. Also, each of the grips 2*a* to 2*d* has the component 4 including "a top face portion 4A, a side face portion 4B, and a rear face portion 4C" that form "a top side, a part of the other side, and a part of the rear side" thereof, respectively.

The component 3 includes three openings, that is, a front opening portion 3*a* and a front opening portion 3*b* provided such that the operator can insert one's fingers, and an upper opening portion 3*c* provided such that the component 4 can be fitted on an upper side of the first side face portion 3B and an upper side of the rear face portion 3D.

The grips 2*a* to 2*d* can each be held by the operator in a state in which the operator inserts one's fingers in the spaces provided in the grips 2*a* to 2*d* and on upper sides of the front opening portion 3*a* and the front opening portion 3*b* from the front opening portion 3*a* and the front opening portion 3*b*. Thus, the operator can lift the outdoor unit 1 and can shift the outdoor unit 1 in the horizontal direction.

[Front Face Portion 3A of Component 3]

The component 3 has the front face portion 3A that forms the front side of the corresponding grip 2*a*, 2*b*, 2*c*, or 2*d*. The front face portion 3A has the front opening portion 3*a* that allows the operator to insert one's fingers in the grip 2*a*, 2*b*, 2*c*, or 2*d*.

At the other side end of the front face portion 3A, a groove portion 7*b* extends in the up-down direction. The component 3 and the component 4 are assembled such that a turn-back portion 10*b* provided in the rear face portion 4C of the component 4 is inserted in the groove portion 7*b*.

The front face portion 3A has a rib 3AA with which, for example, the palm of the operator's hand is to contact when the operator holds the outdoor unit 1 while inserting one's fingers in the grips 2*a* to 2*d*. This rib 3AA reduces the pressure applied to the operator's hand, and can reduce the load on the operator who is carrying the outdoor unit 1.

At an upper end of the front face portion 3A, a projection 6 is provided to allow the component 3 and the component 4 to be fitted each other.

[First Side Face Portion 3B of Component 3]

The component 3 has the first side face portion 3B that forms one side of the corresponding grip 2*a*, 2*b*, 2*c*, or 2*d*. On a lower side of the first side face portion 3B, the front opening portion 3*b* is provided to allow the operator to insert one's fingers in the grip 2*a*, 2*b*, 2*c*, or 2*d*. In this way, the component 3 is continuously open through the front opening portion 3*b* and the front opening portion 3*a* provided on the front side of the component 3. For this reason, the operator can insert one's fingers in the grip 2*a*, 2*b*, 2*c*, or 2*d* through the front opening portion 3*a* and the front opening portion 3*b*. This can suppress degradation of operability in carrying the outdoor unit 1.

At a rear end of the first side face portion 3B, a groove portion 7*b* extends in the up-down direction. The component 3 and the component 4 are assembled such that a turn-back portion 10*b* provided on the rear side portion 4C of the component 4 is inserted in the groove portion 7*b*.

Similarly to the front face portion 3A, the first side face portion 3B has a rib 3BB. This rib 3BB continues from the rib 3AA.

The first side face portion 3B is connected at a front end to the front face portion 3A and at a rear end to the rear face portion 3D.

[Second Side Face Portion 3C of Component 3]

The component 3 has the second side face portion 3C that forms the other side of the corresponding grip 2*a*, 2*b*, 2*c*, or 2*d*. The component 4 is fitted on the second side face portion 3C, so that the entirety of the other side of the grip 2*a*, 2*b*, 2*c*, or 2*d* is formed.

A tight contact face 7*a* is provided at an upper end of the second side face portion 3C. The component 3 and the component 4 are assembled such that the tight contact face 7*a* is in tight contact with a tight contact face 10*a* provided at a lower end of the component 4.

A claw 8*b* is provided on a front side of the second side face portion 3C to allow the component 3 and the component 4 to be fitted each other. The component 3 and the component 4 are assembled such that the claw 8*b* is engaged with a claw 11*b* provided in the component 4.

The second side face portion 3C is connected at a front end to the front face portion 3A, at a rear end to the rear face portion 3D, and at a lower end to the bottom face portion 3E.

[Rear Face Portion 3D of Component 3]

The component 3 has the rear face portion 3D that forms a rear side of the corresponding grip 2*a*, 2*b*, 2*c*, or 2*d*. The component 4 is fitted on an upper side of the rear face portion 3D, so that the entirety of the rear side of the grip 2*a*, 2*b*, 2*c*, or 2*d* is formed.

A tight contact face 7*a* is provided at an upper end of the rear face portion 3D. The component 3 and the component 4 are assembled such that the tight contact face 7*a* is in tight contact with a tight contact face 10*a* provided at a lower end of the component 4.

One side of the rear face portion 3D has a substantially vertical face. In contrast, the other side of the rear surface of the component 3 has a curved portion 3DD that is curved from the rear side toward the front side of the component 3 as it extends toward the other side. Since each component 3 has such a curved portion 3DD, the grips 2*a* to 2*d* are unlikely to interfere with the outdoor heat exchanger 15, pipes, etc. mounted in the outdoor unit 1, and this can suppress damage to the outdoor heat exchanger 15, the pipes, etc. That is, the spaces of the grips 2*a* to 2*d* each defined by the component 3 and the component 4 are expanded so that operator's fingers can be easily inserted therein. However, even when the spaces are expanded, damage to the outdoor heat exchanger 15, the pipes, etc. can be suppressed.

The one side of the rear face portion 3D has a claw 8*a* that allows the component 3 and the component 4 to be fitted each other. The component 3 and the component 4 are assembled such that the claw 8*a* is engaged with a claw 11*a* provided on the rear side and on one side of the component 4.

The rear face portion 3D is connected at one side end to the first side face portion 3B, at the other side end to the second side face portion 3C, and at a lower end to the bottom face portion 3E.

[Bottom Face Portion 3E of Component 3]

The component 3 has the bottom face portion 3E that forms the bottom side of the corresponding grip 2*a*, 2*b*, 2*c*, or 2*d*. On the bottom face portion 3E, the second side face portion 3C and the rear face portion 3D stand. The bottom face portion 3E is inclined with respect to the horizontal plane. That is, the bottom face portion 3E is not parallel to an upper surface opposed thereto in a state in which the grip 2*a*, 2*b*, 2*c*, or 2*d* is assembled, but is inclined with respect to the upper surface (see FIG. 7).

Since each bottom face portion 3E is inclined in this way, when the grips 2*a* to 2*d* are attached to the outdoor unit 1, this inclination serves as a back clearance. That is, when the grips 2*a* to 2*d* are attached to the outdoor unit 1, they can be restricted from being caught by end faces of the outer panel 1*b* and the side panel 1*c*. Thus, the grips 2*a* to 2*d* are easily attached to the outdoor unit 1.

Next, flange portions 14A to 14F used when attaching the grips 2*a* to 2*d* to the outdoor unit 1 will be described.

As illustrated in FIG. 4(*f*), a flange portion 14A is provided at the upper end of the front face portion 3A. Further, a flange portion 14B is provided from the other side end of the front face portion 3A toward a front end of the second side face portion 3C. Still further, a flange portion 14C is provided at a front end of the bottom face portion 3E.

As illustrated in FIG. 4(*d*), a flange portion 14D is provided at an upper end of the first side face portion 3B. Further, a flange portion 14E is provided from a rear end of the first side face portion 3B toward one side end of the rear face portion 3D. Still further, a flange portion 14F is provided at one side end of the bottom face portion 3E.

While the flange portions 14A to 14E are continuously formed in FIG. 4, alternatively, they may be interrupted.

[Top Face Portion 4A of Component 4]

Each component 4 has the top face portion 4A that forms a top side of the corresponding grip 2*a*, 2*b*, 2*c*, and 2*d*. In a front end portion of the top face portion 4A, a top face hole 9 is provided to be fitted on the projection 6 of the component 3. Also, the side face portion 4B and the rear face portion 4C stand in the component 4.

The top face portion 4A and the side face portion 4B are connected to be substantially orthogonal to each other, and the top face portion 4A and the rear face portion 4C are connected to be substantially orthogonal to each other. This can restrict internal spaces of the grips 2*a* to 2*d* from being narrowed, and can more reliably ensure spaces in which operator's fingers are to be inserted.

While the top face portion 4A is connected to the side face portion 4B and the rear face portion 4C such as to be "substantially orthogonal" thereto in Embodiment 1, the present invention is not limited thereto. For example, the spaces in which the operator's fingers are to be inserted can be more reliably ensured as long as the top face portion 4A is provided on a side higher than the upper end of the front face portion 3A and the upper end of the first side face portion 3B.

[Side Face Portion 4B of Component 4]

The component 4 has the side face portion 4B that forms the other side of the corresponding grip 2*a*, 2*b*, 2*c*, or 2*d* with the second side face portion 3C of the component 3. The side face portion 4B is a part of a second-component opposed portion. At a lower end of the side face portion 4B, a tight contact face 10*a* is provided to be in contact with the tight contact face 7*a* of the component 3 in a state in which the component 3 and the component 4 are assembled. A claw 11*b* to be engaged with the claw 8*b* of the component 3 is provided on a front side of the side face portion 4B.

At a front end of the side face portion 4B, a turn-back portion 10*b* extends in the up-down direction such as to be turned back from the other side toward the front side of the grip 2*a*, 2*b*, 2*c*, or 2*d*. That is, the front end of the side face portion 4B is substantially L-shaped in horizontal cross section. The turn-back portion 10*b* is inserted in the groove portion 7*b* of the front face portion 3A of the component 3, so that the component 3 and the component 4 are assembled.

[Rear Face Portion 4C of Component 4]

The component 4 has the rear face portion 4C that forms the rear side of the corresponding grip 2*a*, 2*b*, 2*c*, or 2*d* with the rear face portion 3D of the component 3. The rear face portion 4C is a part of the second-component opposed portion. At a lower end of the rear face portion 4C, a tight contact face 10*a* is provided to be in contact with the tight contact face 7*a* of the component 3 in a state in which the component 3 and the component 4 are assembled.

One side of the rear face portion 4C has a substantially vertical face. In contrast, the other side of the rear face portion of the component 4 has a curved portion 4CC that is curved from the rear side toward the front side of the component 3 as it extends toward the other side. Since the rear face portion 4C has the curved portion 4CC corresponding to the rear face portion 3D of the component 3 in this way, it can suppress damage to the outdoor heat exchanger 15, the pipes, etc. On the one side of the rear face portion 4C, a claw 11*a* is provided to be engaged with the claw 8*a* of the component 3.

On the one side of the rear face portion 4C, a turn-back portion 10*b* extends in the up-down direction to be turned back from the rear side toward the one side of the grip 2*a*, 2*b*, 2*c*, or 2*d*. That is, the one side of the rear face portion 4C is substantially L-shaped in horizontal cross section. The turn-back portion 10*b* is inserted in the groove portion 7*b* of the first side face portion 3B of the component 3, so that the component 3 and the component 4 are assembled.

The horizontal strength of the component 3 and the component 4 can be ensured by "connection between the tight contact face 7*a* of the component 3 and the tight contact face 10*a* of the component 4" and "connection between the groove portion 7*b* of the component 3 and the turn-back portion 10*b* of the component 4."

Further, the vertical strength of the component 3 and the component 4 can be ensured by connection between the claws 8*a* and 8*b* of the component 3 and the claws 11*a* and 11*b* of the component 4.

[Detailed Description 2 of Grips 2*a* to 2*d*]

Figure 6:
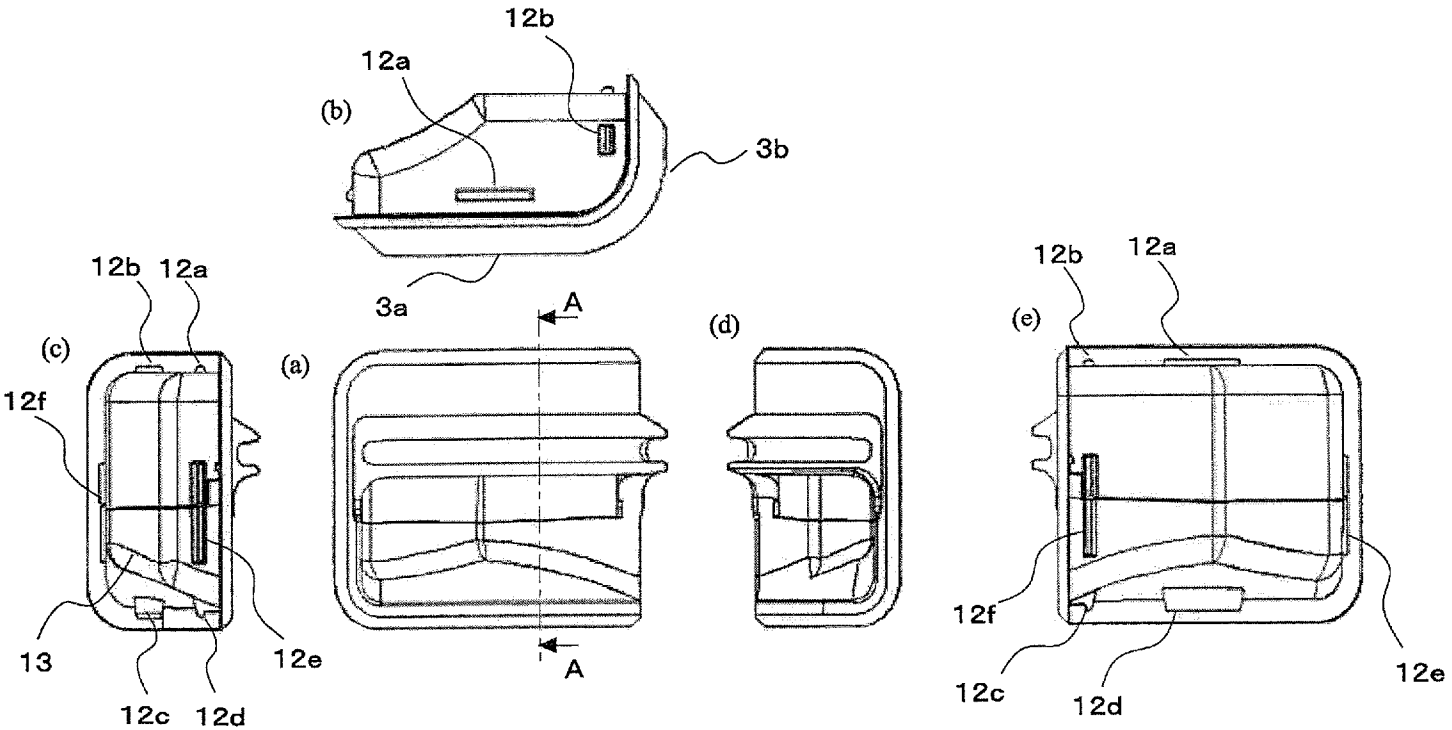
FIG. 6 includes explanatory views illustrating a state in which the component of FIG. 4 and the component of FIG. 5 are assembled.
Figure 7:
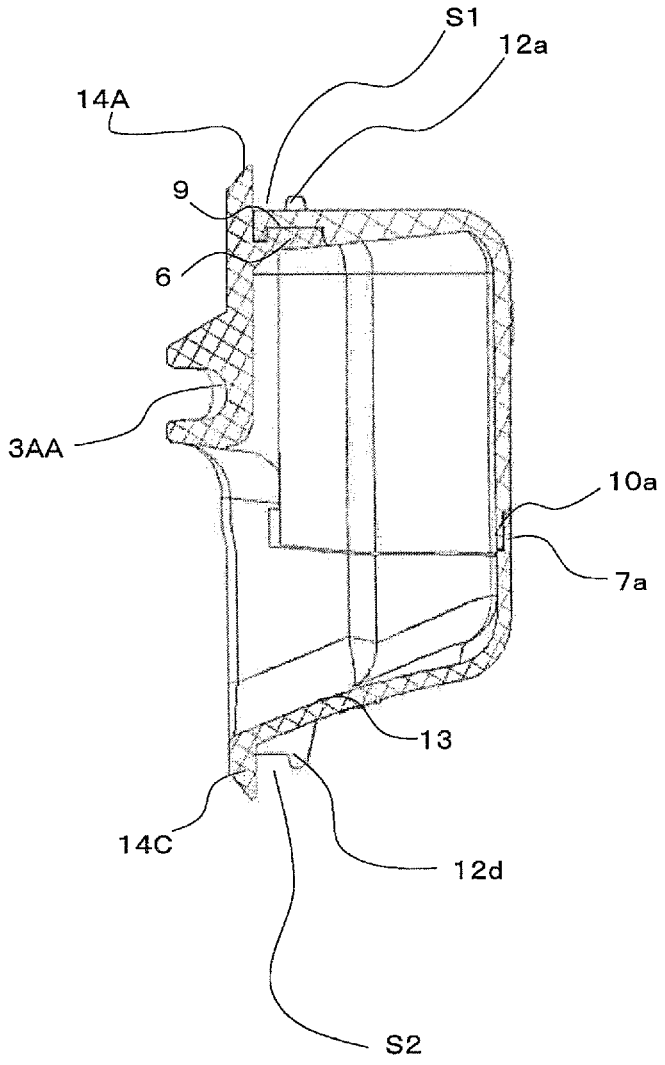
FIG. 7 is a cross-sectional view taken along line A-A of FIG. 6.

FIG. 6 includes explanatory views illustrating a state in which the component of FIG. 4 and the component of FIG. 5 are assembled. FIG. 7 is a cross-sectional view taken along line A-A of FIG. 6. With reference to FIGS. 6 and 7, the structure of the grips 2*a* to 2*d* will be described in more detail. FIG. 6(*a*) is a front view, FIG. 6(*b*) is a top view, FIG. 6(*c*) is a left side (the other side) view with respect to the front side, FIG. 6(*d*) is a right side (one side) view with respect to the front side, and FIG. 6(*e*) is a rear view.

Embodiment 1 assumes that the grips 2*a* to 2*d* are attached to the corners of the outer panel 1*b* and the side panel 1*c* of the outdoor unit 1. For this reason, the grips 2*a* to 2*d* are fitted in the openings at the corners provided in the outer panel 1*b* and the side panel 1*c*. Here, the grips 2*a* to 2*d* have projections 12*a* to 12*f*, and the grips 2*a* to 2*d* are fitted in the above-described openings at the corners by utilizing the projections 12*a* to 12*f*. The projections 12*a* to 12*f* will be described below.

The projection 12*a* is provided on the front side of the top face portion 4A of the component 4. A predetermined gap is provided between the projection 12*a* and the flange portion 14A (see S1 of FIG. 7). That is, an end face of the outer panel 1*b* or the side panel 1*c* is fitted between the projection 12*a* provided on an inner structure side of the outdoor unit 1 and the flange portion 14A.

The projection 12*b* is provided on the one side of the top face portion 4A of the component 4. A predetermined gap is provided between the projection 12*b* and the flange portion 14D. That is, an end face of the outer panel 1*b* or the side panel 1*c* is fitted between the projection 12*b* provided on the inner structure side of the outdoor unit 1 and the flange portion 14D.

The projection 12*c* is provided on one side of the bottom face portion 3E of the component 3. A predetermined gap is provided between the projection 12*c* and the flange portion 14F. That is, an end face of the outer panel 1*b* or the side panel 1*c* is fitted between the projection 12*c* provided on the inner structure side of the outdoor unit 1 and the flange portion 14F.

The projection 12*d* is provided on a front side of the bottom face portion 3E of the component 3. A predetermined gap is provided between the projection 12*d* and the flange portion 14C (see S2 of FIG. 7). That is, an end face of the outer panel 1*b* or the side panel 1*c* is fitted between the projection 12*d* provided on the inner structure side of the outdoor unit 1 and the flange portion 14C.

The projection 12*e* is provided on the second side face portion 3C of the component 3 and the side face portion 4B of the component 4. A predetermined gap is provided between the projection 12*e* and the flange portion 14B. That is, an end face of the outer panel 1*b* or the side panel 1*c* is fitted between the projection 12*e* provided on the inner structure side of the outdoor unit 1 and the flange portion 14B.

The projection 12*f* is provided on the rear face portion 3D of the component 3 and the rear face portion 4C of the component 4. A predetermined gap is provided between the projection 12*f* and the flange portion 14E. That is, an end face of the outer panel 1*b* or the side panel 1*c* is fitted between the projection 12*f* provided on the inner structure side of the outdoor unit 1 and the flange portion 14E.

In this way, the grips 2*a* to 2*d* are fitted in the outer panel 1*b* and the side panel 1*c* of the outdoor unit 1. This restricts the grips 2*a* to 2*d* from moving in the horizontal direction and the vertical direction.

[Advantages of Outdoor Unit 1 for Air-Conditioning Apparatus according to Embodiment 1]

The outdoor unit 1 for the air-conditioning apparatus according to Embodiment 1 includes the grips 2*a* to 2*d* each composed of the component 3 and the component 4 that are formed to expand the inner space. Hence, the operator's fingers can be easily inserted in the grips 2*a* to 2*d*, and this can suppress degradation of operability in carrying the outdoor unit 1.

For example, the upper portion of the conventional grip is shaped to be inclined in the form of a curved face from the front side toward the rear side so as to facilitate the operation of taking out the injection-molded grip from the mold. When the upper portion of the grip is thus inclined from the front side toward the rear side, this inclination narrows the inner space of the grip, and it is difficult for the operator to insert one's fingers therein. However, in the grips 2*a* to 2*d* of the outdoor unit 1 for the air-conditioning apparatus according to Embodiment 1, "the rear face portion 4C is substantially orthogonal to the top face portion 4A" or "the top face portion 4A is provided on a side higher than the upper ends of the front face portion 3A and the first side face portion 3B." This restricts the inner spaces of the grips 2*a* to 2*d* from being narrowed, and therefore, fingers of the operator can be easily inserted therein.

In the outdoor unit 1 for the air-conditioning apparatus according to Embodiment 1, each of the grips 2*a* to 2*d* is composed of two components, that is, the component 3 and the component 4.

If each of the grips 2*a* to 2*d* is integrally formed as a single component, the following problem sometimes occurs. That is, a portion corresponding to the bottom face portion 3E is inclined with respect to the rear side (on a side of the rear face portion 3D and the rear face portion 4C) of the grip 2*a*, 2*b*, 2*c*, or 2*d*, but a portion corresponding to the top face portion 4A is not inclined with respect to the rear side of the grip 2*a*, 2*b*, 2*c*, or 2*d*. This portion that is not inclined is likely to be caught by the mold. Hence, the grips 2*a* to 2*d* are each not easily taken out of the mold, and this causes a manufacturing problem.

In contrast, since each of the grips 2*a* to 2*d* in the outdoor unit 1 for the air-conditioning apparatus of Embodiment 1 is composed of two components, that is, the component 3 and the component 4, the problem in that the grips 2*a* to 2*d* are not easily taken out from the mold is unlikely to occur.

In the outdoor unit 1 for the air-conditioning apparatus of Embodiment 1, the claw 8*a* and the claw 8*b*, the claw 11*a* and the claw 11*b*, the tight contact face 7*a* and the tight contact face 10*a*, the groove portion 7*b* and the turn-back portion 10*b*, and the projection 6 and the top face hole 9 are all provided on non-design surfaces of each of the grips 2*a* to 2*d*. That is, this structure provided to aim to fit the component 3 and the component 4 to form each of the grips 2*a* to 2*d* prevents the design of the outdoor unit 1 from being impaired.

In the outdoor unit 1 for the air-conditioning apparatus according to Embodiment 1, the grips 2*a* to 2*d* have "a structure that is different" on both sides of a boundary between the tight contact face 7*a* and the tight contact face 10*a*. Hence, "the boundary is horizontal." That is, a side opposed to the front face portion 3A, a side opposed to the bottom face portion 3E, and a side opposed to the first side face portion 3B in the component 3 define the upper opening portion 3*c*, and the component 4 is located in the upper opening portion 3*c*.

For this reason, even if water enters any of the grips 2*a* to 2*d*, for example, because of rainfall, since the grips 2*a* to 2*d* have the structure in which "the boundary is horizontal", water drops falling in the gravitational direction (vertical direction) in the grips 2*a* to 2*d* are unlikely to enter the outdoor unit 1 from the boundary. That is, since each of the grips 2*a* to 2*d* is composed of two components, that is, the component 3 and the component 4, the boundary between the component 3 and the component 4 is formed on the inner side of the outdoor unit 1. However, since the grips 2*a* to 2*d* have the structure in which "the boundary is horizontal", it is possible to reduce the probability that the water drops will enter the outdoor unit 1.

For example, since various electric devices utilized to drive the compressor and the like are installed in the outdoor unit 1, it is possible to restrict the electric devices from short-circuiting.

While each of the grips 2*a* to 2*d* is composed of the component 3 and the component 4 having different shapes in Embodiment 1, the present invention is not limited thereto. For example, a grip may be obtained by combining a right component and a left component having the same shape although the shape of the grip is different from that of the grips 2*a* to 2*d*. Even the grip thus composed of the components having the same shape can obtain advantages similar to those of the grips 2*a* to 2*d* in the outdoor unit 1 for the air-conditioning apparatus of Embodiment 1.

While Embodiment 1 assumes that the grips 2*a* to 2*d* are attached to the corners of the outer panel 1*b* and the side panel 1*c* in the outdoor unit 1 for the air-conditioning apparatus, the present invention is not limited thereto. For example, even when the grips 2*a* to 2*d* are attached to planar portions of the outer panel 1*b* and the side panel 1*c* of the outdoor unit 1, advantages similar to those of the grips 2*a* to 2*d* in the outdoor unit 1 for the air-conditioning apparatus of Embodiment 1 can be obtained.

REFERENCE SIGNS LIST

1: outdoor unit, 1*a:* top panel, 1*b:* outer panel, 1*c:* side panel, 1*cc:* plural apertures, 1*d:* fan guard, 1*e:* bottom plate, 11: propeller fan, 2*a* to 2*d:* grip, 3: component (first component), 3*a:* front opening portion (second opening portion), 3*b:* front opening portion (second opening portion), 3*c:* upper opening portion (first opening portion), 3A: front face portion, 3AA: rib, 3B: first side face portion, 3BB: rib, 3C: second side face portion, 3D: rear face portion, 3DD: curved portion, 3E: bottom face portion, 4: component, 4A: top face portion (second-component top face portion), 4B: side face portion (second-component opposed portion), 4C: rear face portion (second-component opposed portion), 4CC: curved portion, 6: projection, 7*a:* tight contact face, 7*b:* groove portion, 8*a:* claw, 8*b:* claw, 9: top face hole, 10*a:* tight contact face, 10*b:* turn-back portion, 11*a:* claw, 11*b:* claw, 12*a* to 12*f:* projection, 13: inclined portion, 14A to 14F: flange portion, 15: outdoor heat exchanger.

The invention claimed is:

1. An outdoor unit for an air-conditioning apparatus, comprising a grip formed by fitting two components, a space that allows fingers to be inserted being formed between the fitted two components, wherein a first component serving as one of the two components includes a first opening portion provided on an upper side of the first component such that a second component is fitted on the first opening portion, and a second opening portion positioned in correspondence with an installation position of the outdoor unit and used when a finger is inserted, and wherein the second component serving as the other of the two components includes second-component opposed portions that form surfaces opposed to surfaces forming the second opening portion of the grip, and a second-component top face portion that forms a top surface of the grip, and wherein the second-component top face portion is located at a height equal to or more than a height of an upper end of the first component.

2. The outdoor unit for the air-conditioning apparatus of claim 1, wherein second component is formed such that lower ends of the second-component opposed partitions thereof are parallel to a substantially horizontal direction, the lower ends being contact with the first component, wherein, in correspondence with the lower ends of the second-component opposed portions parallel to the substantially horizontal direction, the first component is formed such that contact portions of the first opening portion are parallel to the substantially horizontal direction, the contact portions being in contact with the lower ends of the second-component opposed portions, and wherein the first component and the second component are fixed to be in tight contact with each other at the contact portions.

3. The outdoor unit for the air-conditioning apparatus of claim 2, wherein the second component includes turn-back portions turned back to side ends at the side ends of the second-component opposed portions, the side ends being in contact with the first component, wherein, in correspondence with the side ends of the second-component opposed portions having the turn-back portions, the first component includes groove portions to which the turn-back portions is connected at contact portions of the first opening portion, the contact portions being in contact with the second-component opposed portions.

4. The outdoor unit for the air-conditioning apparatus of claim 3, wherein the second component includes second-component claws on lower sides of side ends of the second-component opposed portions, the lower sides being in contact with the first component, and wherein, in correspondence with the lower sides of the side ends of the second-component opposed portions having the second-component claws, the first component includes first-component claws fitting to the second-component claws at contact portions of the first opening portion, the contact portions in contact with the lower sides of the side ends of the second-component opposed portions.

5. The outdoor unit for the air-conditioning apparatus of claim 4, wherein the first component includes a bottom face portion that forms a bottom side of the grip, and wherein the bottom face portion is inclined downward from an inner side toward an outer side of the outdoor unit.

6. The outdoor unit for the air-conditioning apparatus of claim 3, wherein the first component includes a bottom face portion that forms a bottom side of the grip, and wherein the bottom face portion is inclined downward from an inner side toward an outer side of the outdoor unit.

7. The outdoor unit for the air-conditioning apparatus of claim 2, wherein the second component includes second-component claws on lower sides of side ends of the second-component opposed portions, the lower sides being in contact with the first component, and wherein, in correspondence with the lower sides of the side ends of the second-component opposed portions having the second-component claws, the first component includes first-component claws fitting to the second-component claws at contact portions of the first opening portion, the contact portions in contact with the lower sides of the side ends of the second-component opposed portions.

8. The outdoor unit for the air-conditioning apparatus of claim 7, wherein the first component includes a bottom face portion that forms a bottom side of the grip, and wherein the bottom face portion is inclined downward from an inner side toward an outer side of the outdoor unit.

9. The outdoor unit for the air-conditioning apparatus of claim 2, wherein the first component includes a bottom face portion that forms a bottom side of the grip, and wherein the bottom face portion is inclined downward from an inner side toward an outer side of the outdoor unit.

10. The outdoor unit for the air-conditioning apparatus of claim 2, wherein the first component includes a flange portion provided at a peripheral edge of the surface in which the second opening portion is provided, wherein the second component includes a projection provided on an outer side surface of the second component, and wherein the grip is fixed to the outdoor unit such that an end face of an outer housing of the outdoor unit is located between the flange portion of the first component and the projection of the second component.

11. The outdoor unit for the air-conditioning apparatus of claim 1, wherein the second component includes turn-back portions turned back to side ends at the side ends of the second-component opposed portions, the side ends being in contact with the first component, wherein, in correspondence with the side ends of the second-component opposed portions having the turn-back portions, the first component includes groove portions to which the turn-back portions is connected at contact portions of the first opening portion, the contact portions being in contact with the second-component opposed portions.

12. The outdoor unit for the air-conditioning apparatus of claim 11, wherein the second component includes second-component claws on lower sides of side ends of the second-component opposed portions, the lower sides being in contact with the first component, and wherein, in correspondence with the lower sides of the side ends of the second-component opposed portions having the second-component claws, the first component includes first-component claws fitting to the second-component claws at contact portions of the first opening portion, the contact portions in contact with the lower sides of the side ends of the second-component opposed portions.

13. The outdoor unit for the air-conditioning apparatus of claim 12, wherein the first component includes a bottom face portion that forms a bottom side of the grip, and wherein the bottom face portion is inclined downward from an inner side toward an outer side of the outdoor unit.

14. The outdoor unit for the air-conditioning apparatus of claim 11, wherein the first component includes a bottom face portion that forms a bottom side of the grip, and wherein the bottom face portion is inclined downward from an inner side toward an outer side of the outdoor unit.

15. The outdoor unit for the air-conditioning apparatus of claim 1 wherein the second component includes second-component claws on lower sides of side ends of the second-component opposed portions, the lower sides being in contact with the first component, and wherein, in correspondence with the lower sides of the side ends of the second-component opposed portions having the second-component claws, the first component includes first-component claws fitting to the second-component claws at contact portions of the first opening portion, the contact portions in contact with the lower sides of the side ends of the second-component opposed portions.

16. The outdoor unit for the air-conditioning apparatus of claim 15, wherein the first component includes a bottom face portion that forms a bottom side of the grip, and wherein the bottom face portion is inclined downward from an inner side toward an outer side of the outdoor unit.

17. The outdoor unit for the air-conditioning apparatus of claim 1, wherein the first component includes a bottom face portion that forms a bottom side of the grip, and wherein the bottom face portion is inclined downward from an inner side toward an outer side of the outdoor unit.

18. The outdoor unit for the air-conditioning apparatus of claim 1, wherein the first component includes a flange portion provided at a peripheral edge of the surface in which the second opening portion is provided, wherein the second component includes a projection provided on an outer side surface of the second component, and wherein the grip is fixed to the outdoor unit such that an end face of an outer housing of the outdoor unit is located between the flange portion of the first component and the projection of the second component.

19. An air-conditioning apparatus comprising the outdoor unit of claim 1, and an indoor unit.

* * * * *